United States Patent [19]

Sato et al.

[11] Patent Number: 4,776,161

[45] Date of Patent: Oct. 11, 1988

[54] UNBONDED PC STEEL STRAND

[75] Inventors: Syuzo Sato; Masamitsu Takei; Shigeo Shoji, all of Chiba, Japan

[73] Assignee: Kawasaki Steel Corporation, Tokyo, Japan

[21] Appl. No.: 798,898

[22] Filed: Nov. 18, 1985

[30] Foreign Application Priority Data

Nov. 20, 1984 [JP] Japan ..... 59-243458

[51] Int. Cl.[4] ..... A01D 57/04; D02G 3/00

[52] U.S. Cl. ..... 57/223; 57/217; 57/221; 428/375; 428/377; 428/379; 428/380; 428/383

[58] Field of Search ..... 428/377, 383, 380, 379, 428/375; 57/217, 221, 223, 232

[56] References Cited

U.S. PATENT DOCUMENTS

| | | | |
|---|---|---|---|
| 792,001 | 6/1905 | Callan | 428/380 |
| 1,720,749 | 7/1929 | Schnable | 428/380 |
| 2,687,386 | 8/1954 | Olson | 428/379 |
| 2,989,491 | 6/1961 | Sattler et al. | 428/379 |
| 3,646,748 | 3/1972 | Lang | 57/7 |
| 3,922,437 | 11/1975 | Kitta et al. | 428/383 |
| 4,002,797 | 1/1977 | Hacker et al. | 428/379 |
| 4,016,714 | 4/1977 | Crandall et al. | 428/377 |
| 4,445,321 | 5/1984 | Hutchinson | 57/223 |
| 4,490,969 | 1/1985 | Simpson et al. | 57/217 |

*Primary Examiner*—Sharon A. Gibson
*Attorney, Agent, or Firm*—Austin R. Miller

[57] ABSTRACT

An unbonded PC steel strand used for posttensioning concrete comprising a PC steel strand composed of a plurality of stranded wires, a thin transparent lacquer coating on the outer surface of the PC steel strand, the lacquer coating being able to be broken when the PC steel strand is subjected to tension or posttensioning concrete, a filler applied around the lacquer coating, and a synthetic resin sheath covering the lacquer and filler coated PC steel strand. A method of manufacturing the unbond PC steel strand comprising steps of annealing the PC steel strand at a low temperature to remove strain, coating the outer surface of the PC steel strand with lacquer, applying a greaselike corrosion inhibitor to the surface of this lacquer coating, and sheating the coated PC steel strand with an outer synthetic resin sheath.

1 Claim, 3 Drawing Sheets

UNBONDED PC STEEL STRAND

BACKGROUND OF THE INVENTION

1. Field of the Invention

The present invention relates to unbonded PC (prestress concrete) steel strands having a plastic sheath and used for posttensioning concrete structures, and to a process for making such unbonded PC steel strand.

2. Related Art Statement

In general, unbonded PC steel strands having a plastic sheath have been used for preventing the PC steel strands from bonding to concrete in posttensioning of concrete structures in which PC steel strands placed in concrete are stretched to produce stress in the concrete structures after hardening of concrete.

Conventional unbonded PC steel strands have a corrosion inhibitor such as a greaselike filler between the PC steel strands and their plastic sheaths for improving corrosion protection and lubricity of the PC steel strands as described, for instance, in Japanese Utility Model Application Publication No. 1,160/67, in which the PC steel strand is coated with a filler such as grease or vaseline having fluidity, and then helically wrapped with paper tapes and further continuously covered with a synthetic resin sheath having a certain thickness over the whole length of the steel stranded wire, or in U.S. Pat. No. 3,646,748, in which the PC steel strand is coated with a greaselike corrosion inhibitor of a predetermined thickness, and then covered with a flexible synthetic resin sheath.

The prior unbonded PC steel strands with a greaselike filler between PC steel strands and their sheaths, however, have many problems: The filler penetrates into gaps between stranded wires during the coating operation, increasing the amount of the filler expended in production. Grease adhering to both ends of the PC steel strands must be wiped off at an expenditure of time and labor in order to positively anchor both ends of the PC steel strands in use, and, because complete removal of grease is extremely difficult, positive anchoring of the ends of the PC steel strand cannot be obtained. Furthermore, if the PC steel strands are obliquely or curvedly tensioned, the tensile stress of the strands decreases in accordance with increase in the distance from the anchored end, and the decreasing degree of this tensile stress naturally varies in accordance with curvature and angular change of the stranded wire. A serious disadvantage arises due to a different coefficient of friction of the PC steel strand to a sheath wall, particularly because of nonuniform distribution of the filler in the space between the wires of the strand and the sheath. Therefore, the problem arises that it is difficult to ensure uniform and complete tension over long periods of time.

The above U.S. patent specification also discloses application of a thin coating of a polymer selected from the group consisting of tetrafluoroethylene and copolymers of tetrafluoroethylene with 5 to 35% hexafluoropropylene to the outer surface of the steel strand. Application of such Teflon synthetic resin coating can reduce consumption of the greaselike filler and solve the problem of wiping off grease, but there remains a problem that the greaselike filler does not enter between wires of the PC steel strand and corrosion protection of the PC steel strand wire by the greaselike filler cannot be obtained.

SUMMARY OF THE INVENTION

An object of the invention is to solve the above problems and to provide an improved unbonded PC steel strand having a synthetic resin sheath by coating the PC steel strand with lacquer or other similar anti-corrosive coating having a thickness which allows breaking of the lacquer or coating when the PC steel strand is stretched for posttensioning concrete, so that a grease-like corrosion inhibitor or similar fluid anticorrosive material which is provided between the coating and said synthetic resin sheath can enter into the spaces between the wires after posttensioning of the concrete.

A method of manufacturing the unbonded PC steel strand according to the invention is that the PC steel strand is annealed at a low temperature to remove strain and cooled, thereafter the external surface of the PC steel strand is coated with lacquer, to the surface of this lacquer coating is applied a greaselike corrosion inhibitor, and an outer synthetic resin sheath is further covered thereon.

The lacquer coating process may be carried out as a different step from the annealing step, but it may be included in an annealing line. In case of coating lacquer at the annealing line, the temperature of the PC steel strand may be maintained constant by controlling cooling conditions such as flow rate and temperature of cooling water, cooling distance, and the like when the PC steel strand is cooled through cooling water in a cooling tank. Coating efficiency can be improved by maintaining the temperature of the PC steel strand after water cooling at 50°±5° C., for instance. Further, a drying process can be omitted by maintaining the temperature of PC steel strand within the range of 30°-80° C.

The lacquer coating process may be carried out by passing the PC steel strand maintained within the above mentioned temperature range through a lacquer liquid maintained at a temperature of 30°-80° C., preferably 50° C., in a lacquer coating tank, or may be carried out by applying lacquer to the PC steel strand by spray or shower. The excess lacquer on the surface of the PC steel strand may be removed by an air wiper or rubber wiper. The coating lacquer is dried by blowing with hot air. This lacquer coating stepmay be carried out once, but it is preferable to perform it twice. If the temperature of the PC steel strand per se at the time of lacquer coating is maintained at 30°-80° C., it is possible to omit drying after air wiping.

The lacquer coating is made of nitrocellulose lacquer, nitrocellulose lacquer mixed with 1-99% of other cellulose lacquer or with 1-99% of acryl lacquer. The viscosity of the lacquer is 1/10 second-200 second, preferably 10-20 second. The thickness of the lacquer coating is 1-100 μm at the outer surface of the wire and it is preferable to fill a part of the grooves between wires.

According to the invention, at the time of production, the greaselike filler is applied to the dry lacquer coating to fill the space between the lacquer coating and the synthetic resin sheath, but does not enter into the gaps between stranded wires, so that a grease layer having a predetermined thickness can be provided with a comparatively small amount or a predetermined amount of grease and the covering by the sheath can easily be carried out.

Further, the thickness of the lacquer coating is such that the coating is broken when the PC steel strand is stretched upon posttensioning after the concrete hardens, bringing about directly contact of the grease-like filler with the PC steel strand for the first time after posttensioning, thereby providing anticorrosion protection of the stranded wires by penetrating into each space between wires of the PC steel strand.

Furthermore, for anchoring both ends of the PC steel strand, clean end portions can be obtained by removing the coating, resulting in a sufficient bond with grout material.

BRIEF DESCRIPTION OF THE DRAWINGS

An embodiment of the invention is illustrated in the accompanying drawings, in which.

DESCRIPTION OF THE PREFERRED EMBODIMENT

Figure 1:
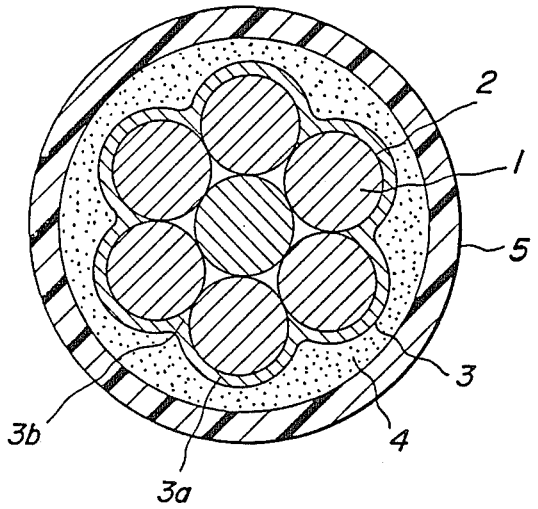
FIG. 1 is a cross-sectional view of an unbonded PC steel strand according to the invention.

The present invention will be explained in more detail referring to the drawings.

Referring to FIG. 1, the unbonded PC steel strand includes a PC steel strand 2 composed of a plurality of wires 1 which are helically stranded. The outer surface of the PC steel strand 2 is coated with thin lacquer 3. To the lacquer coating 3 is applied a filler 4 such as a greaselike corrosion inhibitor around the outer surface of the lacquer coating 3. The PC steel strand 2 coated with a layer or layers of the lacquer coating 3 and the filler 4 is sheathed with a continuous tubular synthetic resin sheath 5. The thickness of the lacquer coating 3 is so determined that the lacquer layer 3 will not be broken at the time of manufacture, transportation, handling amd storage, but that the lacquer layer will break when the PC steel strand is tensioned for posttensioning of concrete. The thickness of the coating is preferably sufficient to resist friction between the PC steel strand 2 and the sheath 5 and the coating itself possesses an anticorrosive effect.

As the filler 4 between the lacquer coating 3 and the sheath 5, use may be made of not only the above described greases but also any other corrosion inhibitor possessing fluidity in the same manner.

The PC steel strand 2 may be composed of zinc plated PC steel wires, thereby improving fatigue strength and preventing rust at the anchored portions.

Figure 2:
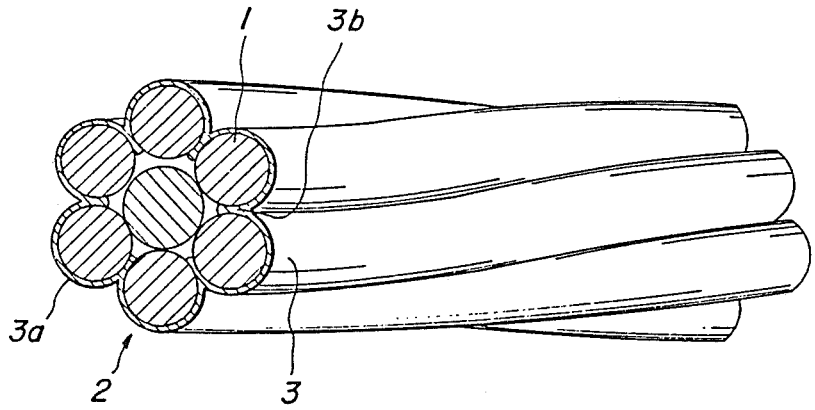
FIG. 2 is a side view of the PC steel strand coated with lacquer according to the invention.
Figure 3:
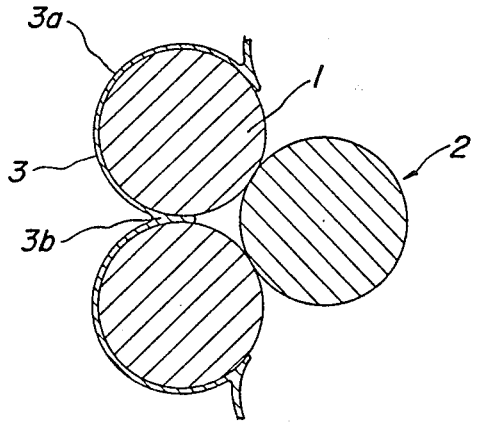
FIG. 3 is a partial enlarged cross-sectional view of the PC steel strand shown in FIG. 2.
Figure 4:
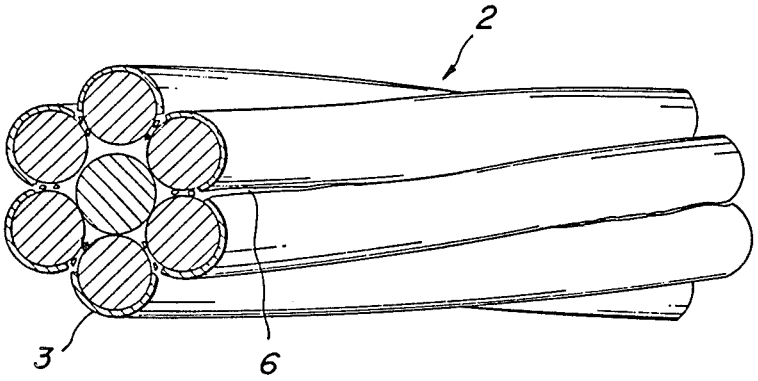
FIG. 4 is a side view similar to FIG. 2 showing the location and character of the cracks produced in lacquer coating by stretching the PC steel strand.
Figure 5:
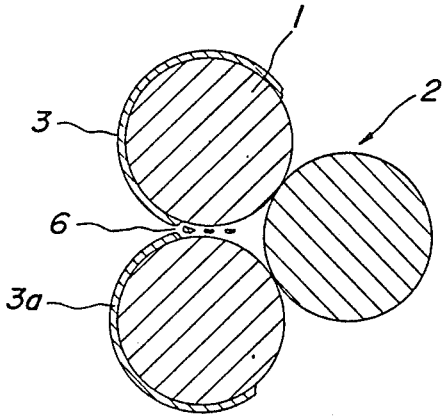
FIG. 5 is a partial enlarged cross-sectional view of the PC steel strand shown in FIG. 4.

FIGS. 2 and 3 show a side view and a partial enlarged cross-sectional view of the PC steel strand 2 coated with lacquer coating 3. The outer surface portion 3*a* of the lacquer coating 3 in this example is 1-10 μm in thickness. FIGS. 4 and 5 show the state of cracking 6 at a groove portion 3*b* of the lacquer coating 3 when the PC steel strand was subjected to a tension of 70% (0.8% elongation) of the strand breaking strength. As a comparative test, a PC steel strand coated with Teflon synthetic resin having the same thickness was subjected to the same tension, but no cracking was produced in the coating.

What is claimed is:

1. An unbonded PC steel strand comprising a PC steel strand composed of a plurality of stranded wires, a thin lacquer coating on the outer surface of the PC steel strands, the lacquer coating comprising a lacquer selected from nitrocellulose lacquer or nitrocellulose lacquer mixed with 1-99% of acryl lacquer and being of such limited thickness of 1-100 μm as to be broken when the PC steel strand is subjected to a tension normally used for posttensioning concrete, but of sufficient thickness to prevent breaking of said lacquer coating during manufacture, shipping, handling, and storage, a greaselike or other anticorrosive, lubricative filler applied around the lacquer coating, and a synthetic resin sheath covering the lacquer-coated, greaselike filler-covered PC steel strand.

* * * * *

UNITED STATES PATENT AND TRADEMARK OFFICE
CERTIFICATE OF CORRECTION

PATENT NO. : 4,776,161

DATED : 10/11/88

INVENTOR(S) : Syuzo Sato; Masamitsu Takei and Shigeo Shoji

It is certified that error appears in the above-identified patent and that said Letters Patent is hereby corrected as shown below: On the title page, Item [73] Kawatetsu Wire Products Co., Ltd. of 4-1-, Shibakoen 2-Chome, Minato-ku, Tokyo, Japan as an assignee of this patent.

Signed and Sealed this

Eighteenth Day of June, 1991

*Attest:*

HARRY F. MANBECK, JR.

*Attesting Officer*

*Commissioner of Patents and Trademarks*